United States Patent [19]

Jackson et al.

[11] Patent Number: 4,504,054

[45] Date of Patent: Mar. 12, 1985

[54] ELBOW BRACE FOR BOWLERS AND GOLFERS

[76] Inventors: Emanuel L. Jackson, 64 Bryant St. NW., Washington, D.C. 20001; Berlin F. Myers, 3709 Halloway N., Upper Marlboro, Md. 20772

[21] Appl. No.: 302,741

[22] Filed: Sep. 16, 1981

[51] Int. Cl.[3] ..... A63B 69/36; A63D 5/00

[52] U.S. Cl. ..... 273/54 B; 273/189 A

[58] Field of Search ..... 128/77, 89; 273/189 A, 273/54 B; 2/16, 161 A; 272/119

[56] References Cited

U.S. PATENT DOCUMENTS

| | | | |
|---|---|---|---|
| 802,623 | 10/1905 | Camp | 273/189 A |
| 1,227,700 | 5/1917 | Tucker | 128/89 R |
| 1,414,012 | 4/1922 | Flint | 273/189 A |
| 2,794,638 | 6/1957 | Risher et al. | 273/189 A X |
| 3,149,839 | 9/1964 | Materia | 272/119 X |
| 3,322,118 | 5/1967 | Sotherlin | 2/16 |
| 3,458,867 | 8/1969 | Moore et al. | 2/16 |
| 3,490,766 | 1/1970 | Gardner | 272/119 |
| 3,533,407 | 10/1970 | Smith | 2/16 X |
| 3,658,345 | 2/1972 | Siggson | 273/189 A |
| 3,776,547 | 12/1973 | Gaboriault | 272/119 |
| 3,900,199 | 8/1975 | McGonagle | 273/189 A |
| 3,911,497 | 10/1975 | Lewis, Jr. et al. | 2/16 |
| 3,975,015 | 8/1976 | Owens et al. | 273/54 B |
| 3,990,709 | 11/1976 | DeRogatis | 273/189 A |
| 4,011,596 | 3/1977 | Chang | 2/16 |
| 4,034,979 | 7/1977 | Wester | 272/119 X |
| 4,040,632 | 8/1977 | Pawl | 273/189 A |
| 4,047,250 | 9/1977 | Norman | 2/161 A |
| 4,120,052 | 10/1978 | Butler | 2/16 |
| 4,132,407 | 1/1979 | Davis | 273/54 B |
| 4,150,442 | 4/1979 | Boone | 2/16 |
| 4,183,098 | 1/1980 | Knowles, Jr. | 2/16 |

*Primary Examiner*—George J. Marlo
*Attorney, Agent, or Firm*—Edward M. Woodberry

[57] ABSTRACT

A limb restraint device (10) which is particularly adapted to be utilized by participants in the sports of bowling and golf. The device comprises a pliable member (12) to be wrapped around a user's elbow and an elongated reinforcing member (14) removably housed in an open-ended casing within the pliable member. The reinforcing member (14) is padded on one side, and is designed to extend longitudinally along the back of the elbow. The pliable member (12) can be releasably fastened so as to maintain the restraint device in position to prevent unwanted elbow movement during movement of the entire arm. The pliable member can take any number of different configurations, and may include, for example, either a continuous strap or multiple straps, for example, wide, medium, and narrow straps, fastened by complimentary hook and pile fasteners such as Velcro ®.

11 Claims, 7 Drawing Figures

FIG. 5
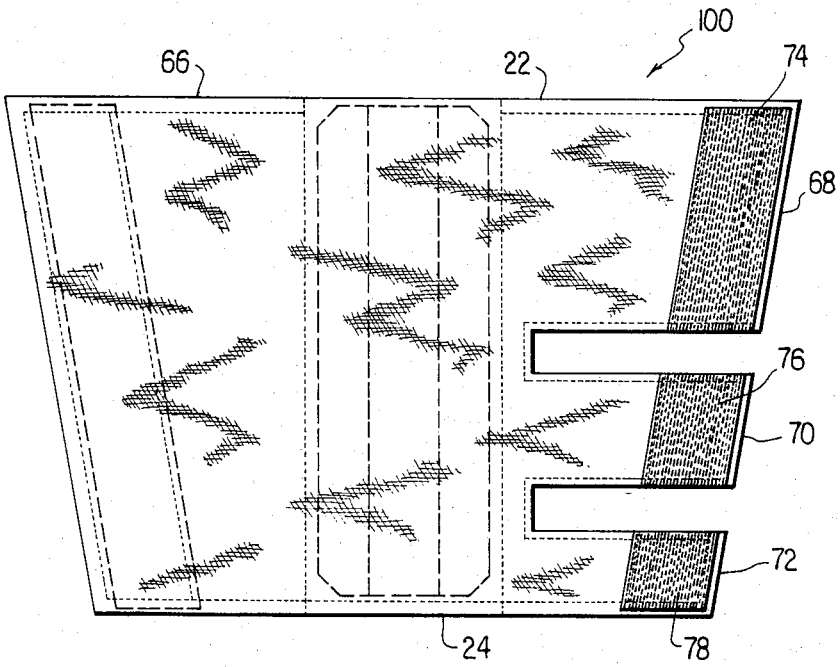
FIG. 4
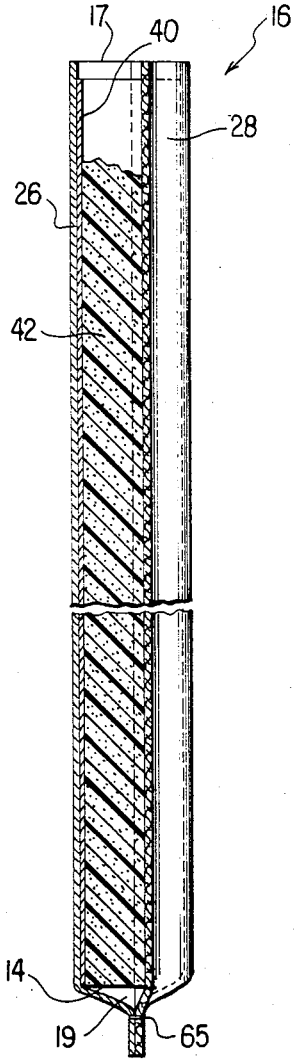
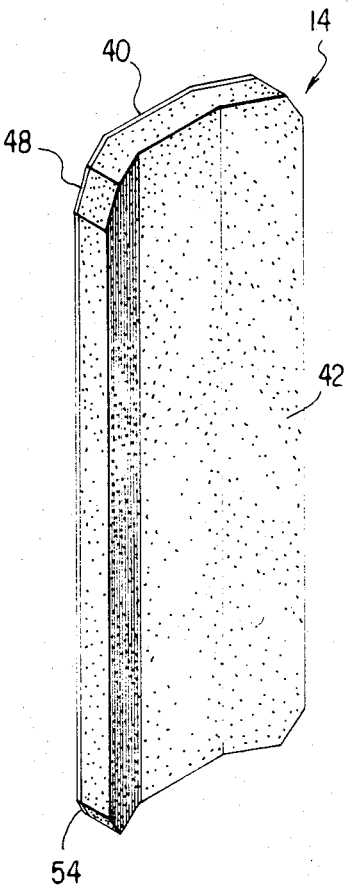
FIG. 6
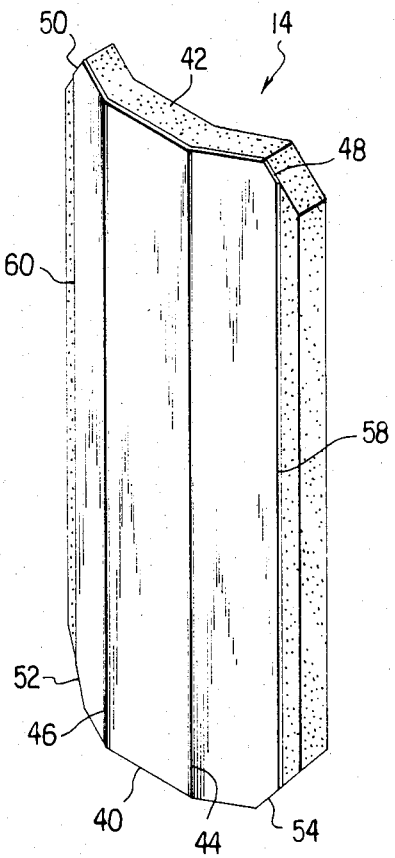
FIG. 7

ELBOW BRACE FOR BOWLERS AND GOLFERS

BACKGROUND OF THE INVENTION

1. Field of the Invention

The present invention is related to limb restraint devices and, more particularly, is directed towards an elbow restraining device which is adapted to be utilized by those who participate in the sports of bowling and golf.

2. Description of the Related Art

The sports of bowling and golf both require the participant to keep a straight arm for optimum performance to be achieved. This is one of the most difficult aspects of either sport for both novices and experienced players to master. A limb restraining device to be used in training would be very helpful in achieving the goal of maintaining a straight arm. The ideal limb restraining device for bowling or golf would keep the arm in a fully-extended position, yet be comfortable, lightweight, easy to to use and durable.

Over the years, many limb restraint devices designed to limit elbow movement while participating in various sports have been suggested. One such device is set forth in U.S. Pat. No. 3,990,709 to DeRogatis. This device comprises a stretchable fabric which houses a plurality of stiffening strips adapted to extend longitudinally along the arm. The strips are closely located as to encircle the arm. While the device appears lightweight and easy to use, it does not appear capable of maintaining the arm in a fully-extended position, thereby allowing some bending of the elbow. Furthermore, the bending which is allowed results in a loss of comfort since as the elbow bends, the stiffening strips along the inside of the arm may tend to cut into the arm.

I am also aware of U.S. Pat. No. 3,975,015 to Owens. This patent teaches a single, angled rigid support member held against the inside of an arm by a plurality of straps. This device is not optimum as it restrains the arm in a bent rather than straight position. Comfort also appears diminished in that the device covers only a part of the user's arm. Without a smooth encircling of the arm, chafing may occur along the edges of the brace.

U.S. Pat. No. 3,658,345 to Siggson and U.S. Pat. No. 3,900,199 to McGonagle both teach devices which hold the arm in a straight position by means of a rigid member held against the back of the arm by a plurality of straps encircling the arm. These devices cover only a portion of the arm thereby exposing the user to chafing from the edges of the rigid member and discomfort from the straps pressing into the user's arm as he tries to bend it.

I am also aware of the following U.S. Pat. Nos. 4,120,052 and 4,183,098.

OBJECTS AND SUMMARY OF THE INVENTION

It is therefore a primary object of the present invention to provide a new and useful limb restraining device particularly adapted to keep the elbow straight for use in playing various sports, and which does so comfortably.

Another object of the present invention is to provide a limb restraining device which can easily accommodate various arm dimensions and strengths.

An additional object of the present invention is to provide a novel and unique limb restraint device that is non-complex, inexpensive, durable and easily cleaned.

These and other objects are accomplished in accordance with the present invention by providing a support of pliable material to be wrapped around a user's arm. The support can be releasably fastened in various circumferences to enable elbow restraint of differently-sized arms. The support may be of a single continuous strap configuration or it may have multiple straps resulting in less restraint and lighter weight. A rigid reinforcing member is removably housed within an open-ended casing in the support. The reinforcing member is preferably U-shaped and is padded on the interior to cushion the user's elbow. The casing is located to allow the reinforcing member to fit against the back of the elbow and run longitudinally along the arm. The reinforcing member can be made of various materials depending upon the required stiffness.

BRIEF DESCRIPTION OF THE DRAWINGS

Further objects, features and attendant advantages of the present invention will be more fully appreciated as the same become better understood from the following detailed description of the present invention when considered in conjunction with the accompanying drawings, in which:

FIG. 4 is a longitudinal sectional view of the present invention taken along line 4—4 of FIG. 2;

FIG. 5 is an elevational view of an alternate embodiment of the present invention;

FIG. 6 is a front perspective view of one embodiment of a reinforcing member of the present invention; and FIG. 7 is a rear perspective view of the reinforcing member of FIG. 6.

DETAILED DESCRIPTION OF THE PREFERRED EMBODIMENT

Figure 2:
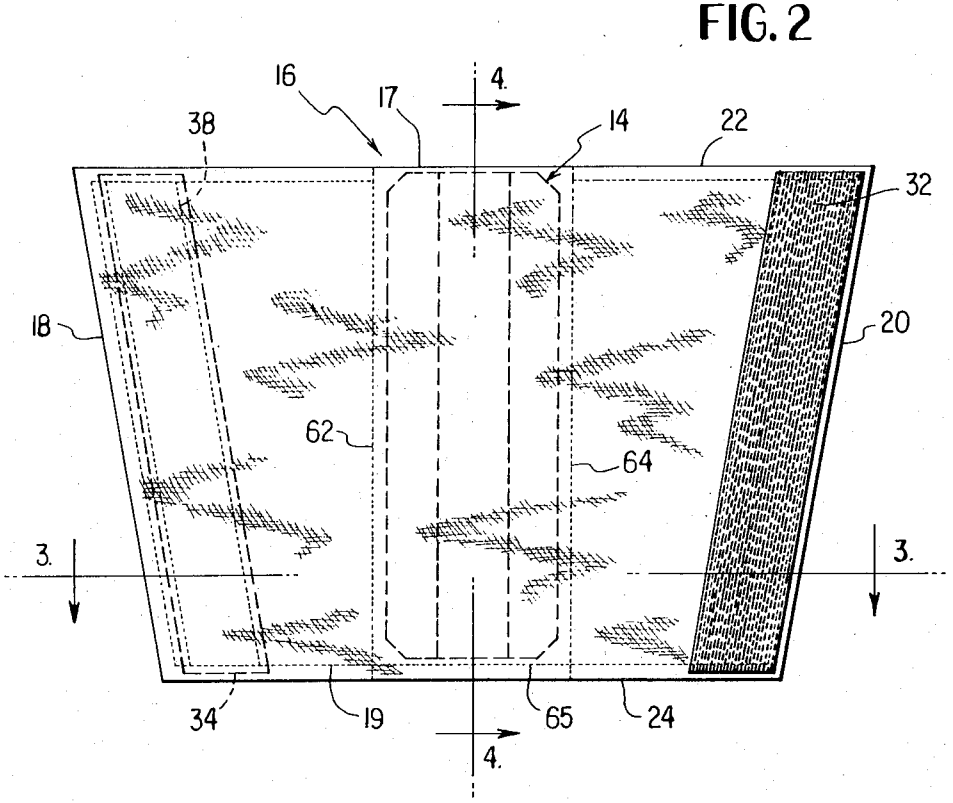
FIG. 2 is an elevational view of the present invention in an unwrapped state.
Figure 1:
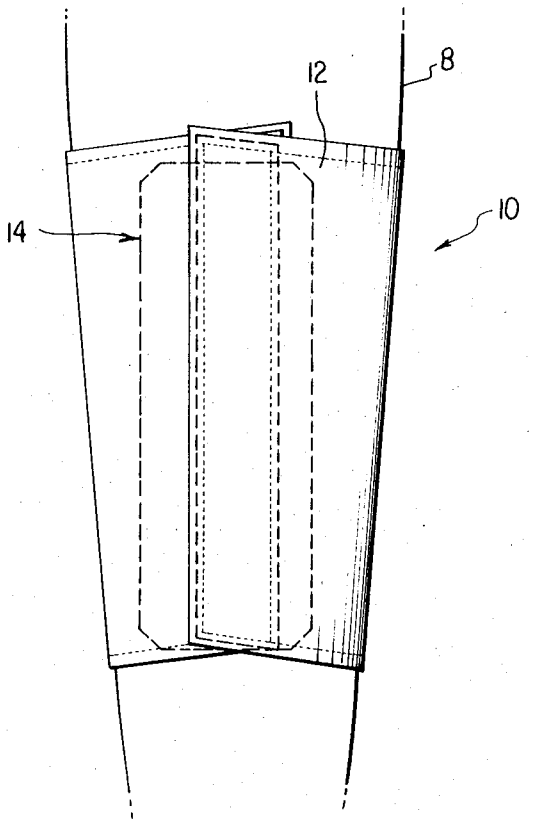
FIG. 1 is a view of a preferred embodiment of the present invention positioned on the arm of a user.

Referring now to the drawings, wherein like reference numerals represent identical or corresponding parts throughout the several views, and more particularly to FIGS. 1 and 2 thereof, reference numeral 10 indicates generally a preferred embodiment of a limb restraint device of the present invention.

The restraint device 10 preferably includes a pliable member 12 adapted to be wrapped around a user's limb 8. The pliable member 12 is preferably trapezoidal in shape and includes opposed side edges 18 and 20, and upper and lower edges 22 and 24, respectively. Side edges 18 and 20, as viewed in FIG. 2, taper inwardly from upper edge 22 to lower edge 24. The relatively wide upper edge 22 encircles the user's limb 8 above the joint and the relatively narrow lower edge 24 encircles the generally more slender limb area below the joint. Side edge tapering, therefore, enables the member 12 to be wrapped smoothly and evenly while minimizing bulky overlap.

Figure 3:
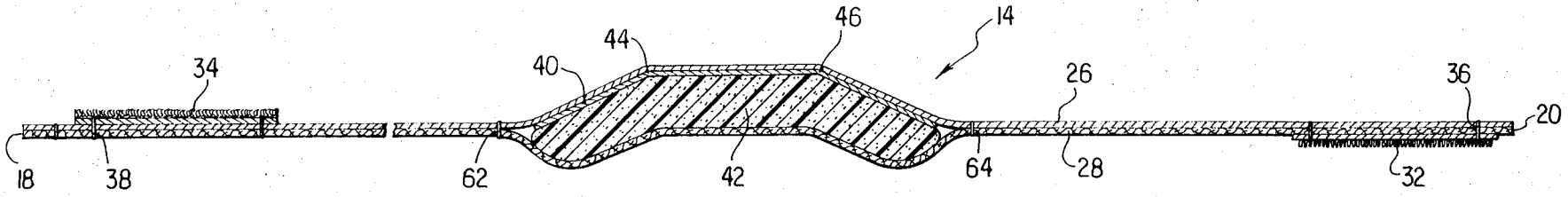
FIG. 3 is a cross-sectional view taken along line 3—3 of FIG. 2.

Pliable member 12 is preferably formed of two layers 26 and 28 of material (see FIG. 3). Layers 26 and 28 preferably consist of a plastic exterior material 26 for durability and a fabric interior material 28 for comfort. Layers 26 and 28 may be joined by various means. For example, FIG. 2 shows them joined by a row of conventional stitching around edges 18, 20, 22 and 24.

Fastening means, preferably comprised of hook means and pile means, such as Velcro®, are used to secure the pliable member 12 around limb 8. An elongated, substantially rectangular hook strip 32 is attached by stitching 36 to the fabric interior material 28 along side edge 20. A complementary pile strip 34 is attached by stitching 38 to the plastic exterior material 26 along the opposite side edge 18.

The restraint device 10 further includes a reinforcing member indicated generally by reference numeral 14. As shown in FIGS. 6 and 7, reinforcing member 14 includes an elongated rigid member 40. In the preferred embodiment, rigid member 40 is formed of thin steel. Two longitudinal bends 44 and 46 preferably form in the steel a U-shaped member intended to cradle the limb. The corners of the rigid member 40 are angled as at 48, 50, 52 and 54 to allow for smoother wrapping of the device.

Secured to member 40 is a layer of padding 42 of substantially the same length as rigid member 40. The padding 42 preferably extends slightly beyond each side edge 58 and 60 of rigid member 40 to provide additional cushioning due to the partial wrap-around effect that occurs along the long parallel side edges 58 and 60.

Designed to removably house the reinforcing member 14 within the pliable member 12 is a casing 16 having an open end 17 and a closed end 19. Casing 16 is preferably centered between the side edges 18 and 20 of pliable member 12 and extends longitudinally in a direction transverse to the direction in which the member 12 is designed to be wrapped. The open end 17 of casing 16 may be formed by two parallel rows of stitching 62 and 64 running from upper edge 22 of member 12 to lower edge 24, combined with stitching 65 parallel to lower edge 24. Casing 16 is therefore defined by the plastic exterior material 26 and the fabric interior material 28. No fastening means are required along the open end 17 because gravity and friction prevent the reinforcing member 14 from falling out of casing 16 once the restraint device 10 is in place. Casing 16 allows easy removal of the reinforcing member 14 for replacement or for easy cleaning of the pliable member 12.

The restraint device 10 is preferably worn by placing the fabric material 28 of the pliable member 12 against the arm, centering it so that the casing 16 containing the reinforcing member 14 runs longitudinally along the arm against the back of the elbow, and wrapping the pliable member 12 around the arm, pressing the hook strip 32 on top of the pile strip 34 to fasten. In this position, shown in FIG. 1, the restraint device 10 acts to keep the user's arm resistant to the natural tendency to bend the elbow, and thus impair performance, while playing certain sports.

Referring now to FIG. 5, there is shown an alternate embodiment 100 of the present invention for use in situations which require a smaller limb restraining force due to either the degree of training or relative strength of the user. In this embodiment, one side of the pliable material 66 is comprised of a number of integral straps 68, 70 and 72, rather than one continuous strap as in the first embodiment. This results in a restraint device 100 that is lighter and cooler, yet does not provide quite as much fastening strength as a one-strap restraint device. The straps 68, 70 and 72 decrease in width; the strap 68 along the upper edge 22 is widest to provide the most fastening strength around the stronger bicep muscles, and the strap 72 along the lower edge 24, which wraps around the forearm, is the narrowest. The hook means of this embodiment consists of co-linear hook strips 74, 76 and 78 positioned on straps 68, 70 and 72, respectively.

Obviously, numerous modifications and variations of the present invention are possible in light of the above teachings. It is therefore to be understood that within the scope of the appended claims, the invention may be practiced otherwise than as specifically described herein.

I claim:

1. An elbow restraint device comprising: a pliable member having a first edge, a second edge, a third edge, a fourth edge, an interior layer and an exterior layer, and which is adapted to be wrapped around the user's arm over the elbow, and which includes an elongated casing having one end which is open, said casing being substantially mid-way between said first edge and said third edge and transverse to the direction in which said member is wrapped in use;

a rigid elongated plate member removably housed within said casing and adapted to fit through said open end and against the back of the arm over the elbow during use, and run longitudinally along the arm, whereby the arm is held in a substantially fully extended position;

a layer of padding attached to one side of said rigid member; and means for fastening said device around the arm, whereby said first edge and said third edge overlap each other when said device is fastened around the arm.

2. A limb restraint device as claimed in claim 1, in which said first edge and said third edge taper inwardly from said second edge to said fourth edge whereby said pliable member is substantially trapezoidally-shaped in repose.

3. A limb restraint device as claimed in claim 2, in which said pliable member comprises a fabric material and a plastic material.

4. A limb restraint device as claimed in claim 3, in which said means for fastening comprises hook means and complementary pile means, said hook means located along said third edge on said interior layer and said pile means located along said first edge on said exterior layer.

5. A limb restraint device as claimed in claim 4, in which said rigid member comprises an elongated plate formed of a thin steel and having a first bend longitudinal to said plate and a second bend parallel to said first bend.

6. A limb restraint device as claimed in claim 5, in which said rigid member has a first corner, a second corner, a third corner and a fourth corner and in which said corners are angled.

7. A limb restraint device as claimed in claim 5, in which said rigid member has a first side edge and a second side edge and in which said padding has a first side edge and a second side edge, said first side edge of said padding extending beyond said first side edge of said rigid member and said second side edge of said padding extending beyond said second side edge of said rigid member.

8. A limb restraint device as claimed in claims 4 or 7, in which said pliable member comprises a plurality of integral straps extending from said third edge to said casing.

9. A limb restraint device as claimed in claim 8, in which said integral straps comprise a wide strap, a medium strap and a narrow strap, said wide strap positioned along said second edge and said narrow strap positioned along said fourth edge.

10. A limb restraint device as claimed in claim 9, in which said hook means comprises co-linear hook strips positioned respectively on said integral straps.

11. An elbow restraint device comprising;

a pliable member having a first edge, a second edge, a third edge, a fourth edge, an interior layer and an exterior layer, and which is adapted to be wrapped around the user's arm over the elbow, and which includes an elongated casing having one end which is open, said casing being substantially mid-way between said first edge and said third edge and transverse to the direction in which said member is wrapped in use;

a rigid elongated plate member removably housed within said casing and adapted to fit through said open end and against the back of the arm over the elbow during use and run longitudinally along the arm, whereby the arm is held in a substantially fully-extended position and a layer of padding attached to one side of said rigid member, said rigid member comprises an elongated plate formed of thin steel and having a first bend longitudinal to said plate and a second bend parallel to said first bend, in which said rigid member has a first corner, a second corner, a third corner and a fourth corner and in which said corners are angled, in which said rigid member has a first side edge and a second side edge and in which said padding has a first side edge and a second side edge, said first side edge of said padding extending beyond said first side edge of said rigid member and said second side edge of said padding extending beyond said second side edge of said rigid member; and means for fastening said device around the arm whereby said first edge and said third edge overlap each other when said device is fastened around the arm.

* * * * *